United States Patent [19]

Faure

[11] Patent Number: 4,923,676

[45] Date of Patent: May 8, 1990

[54] ALUMINIUM ALLOY PARTS, SUCH AS IN PARTICULAR RODS, HAVING AN IMPROVED FATIGUE STRENGTH AND PRODUCTION PROCESS

[75] Inventor: Jean-François Faure, Voiron, France

[73] Assignee: Cegedur Societe de Transformation de l'Aluminium Pechiney, Paris, France

[21] Appl. No.: 275,506

[22] Filed: Nov. 23, 1988

[30] Foreign Application Priority Data

Dec. 7, 1987 [FR] France ..... 87 17674

[51] Int. Cl.[5] ..... C22C 21/00

[52] U.S. Cl. ..... 420/535; 148/11.5 A; 148/12.7 A

[58] Field of Search ..... 420/535; 148/11.5 A, 148/12.7 A

[56] References Cited

U.S. PATENT DOCUMENTS 4,434,014 2/1984 Smith ..... 420/535

*Primary Examiner*—R. Dean

*Attorney, Agent, or Firm*—Dennison, Meserole, Pollack & Scheiner

[57] ABSTRACT

The invention relates to aluminium alloy parts having an improved fatigue strength and to their production process. These parts are made from an alloy containing by weight 11 to 22% silicon, 2 to 5% iron, 0.5 to 4% copper, 0.2 to 1.5% magnesium and having the characteristic of containing 0.4 to 1.5% zirconium. The process for obtaining the same consists of subjecting the alloy in the molten state to fast solidification, shaping, a heat treatment at between 480° and 530° C., hardening with water and tempering at between 150° and 200° C. These parts are more particularly used as rods and piston pins.

3 Claims, No Drawings

ALUMINIUM ALLOY PARTS, SUCH AS IN PARTICULAR RODS, HAVING AN IMPROVED FATIGUE STRENGTH AND PRODUCTION PROCESS

The present invention relates to aluminium alloy parts having an improved fatigue strength and to a process for the production of said parts.

It is known that aluminium is three times lighter than steel and has a good corrosion resistance. On alloying it with metals such as copper and magnesium, its mechanical strength is considerably improved. Moreover, the addition of silicon gives a product having a high wear resistance. These alloys doped with other elements such as iron, nickel, cobalt, chrome and manganese lead to a compromise of properties giving a very suitable material for the production of car parts, such as engines, pistons, cylinders, etc.

Thus, European patent 144 898 teaches an aluminium alloy containing by weight 10 to 36% silicon, 1 to 12% copper, 0.1 to 3% magnesium and 2 to 10% of at least one element chosen in the group Fe, Ni, Co, Cr and Mn.

This alloy can be used in the production of parts for both the aeronautical and the car industries, said parts being obtained by powder metallurgy which, apart from shaping by compacting and drawing, involves an intermediate heat treatment stage at between 250° and 550° C.

Although these parts satisfy the various properties referred to hereinbefore, this does not apply with regards to the fatigue strength. The Expert knows that fatigue corresponds to a permanent, local and progressive change to the metal structure occurring in materials undergoing a succession of discontinuous stresses and which can lead to cracks and even breakages of parts following an application of said stresses in accordance with a varying number of cycles, their intensity usually being well below that which it is necessary to apply to the material in a continuous manner in order to obtain a tensile fracture. It is for this reason that the elasticity modulus, tensile strength and hardness values given in EP 144 898 cannot take account of the fatigue strength of the alloy.

However, it is important for parts such as rods or piston pins, which e.g. are dynamically stressed and exposed to periodic stresses, to have a good fatigue strength.

Thus, in considering this problem, the present Applicant has found that parts manufactured on the basis of the alloys covered by the scope of the aforementioned document had a fatigue strength which might be suitable in certain applications, but said property could be improved by modifying the composition thereof. Therefore the Applicant has developed aluminium alloys containing by weight 11 to 22% silicon, 2 to 5% iron, 0.5 to 4% copper, 0.2 to 1.5% magnesium and characterized in that they also contain 0.4 to 1.5% by weight zirconium.

Thus, the Applicant noted that this alloying element added to the others in a quantity at least equal to 0.4% in order to have an appropriate effect, but not exceeding 1.5%, beyond which there is no significant improvement, had the consequence of increasing the fatigue strength of the parts without prejudicing the other properties obtained with the prior art alloys or their machining capacity.

The invention also relates to a process for obtaining parts from such alloys.

After preparing the alloy with the claimed composition, it comprises melting it at a temperature above 900° C., so as to avoid any premature precipitation phenomenon and then subjecting it to rapid solidification. Thus, as the elements such as iron and zirconium are only very slightly soluble in the alloy, it is vital in order to obtain parts complying with the desired characteristics to prevent any coarse, heterogeneous precipitation of these elements, which is brought about by cooling them as quickly as possible.

There are several ways of bringing about this rapid solidification: either by atomization of the molten metal with the aid of a gas, or mechanical atomization followed by cooling in a gas (air, helium, argon); which leads to powders with a grain size below 400 μm, which are then shaped by cold or hot compacting in a uniaxial or isostatic press, then drawing and/or forging; or by projecting the molten alloy against a cooled metal surface, known as "melt spinning" or "planar flow casting" and whereof descriptions appear in U.S. Pat. No. 4 389 258 and European patent 136 508, which leads to tapes with thicknesses less than 100 μm and which are then shaped by compacting as described hereinbefore; or by spraying the atomized molten alloy in a gas stream against a substrate, which is known as "spray deposition", whereof an example is given in British patent 1 379 261 and which leads to a coherent deposit, which is sufficiently malleable to be shaped, e.g. by forging, drawing or die forging.

This list is obviously not exhaustive.

In order to further improve the precipitation structure, after optionally undergoing machining, the parts undergo heat treatment at between 480° and 530° C. for 1 to 10 hours, are then hardened in water before undergoing a tempering treatment between 150° and 200° C. for 2 to 32 hours, which improves their mechanical characteristics.

The invention will be better understood with the aid of the following application examples:

Six alloys were prepared with the following compositions by weight:

| Alloy No. | Si % | Fe % | Cu % | Mg % | Zr % | Al % |
|---|---|---|---|---|---|---|
| 1 | 18 | 3.0 | 3 | 1.0 | — | remainder |
| 2 | 18 | 3.0 | 3 | 1.0 | 1 | remainder |
| 3 | 12 | 5.0 | 1 | 1.5 | 1.2 | remainder |
| 4 | 15 | 4.0 | 1 | 1 | 0.6 | remainder |
| 5 | 20 | 4.0 | 1 | 1 | 0.8 | remainder |
| 6 | 12 | 5.0 | 3 | 0.8 | 0.2 | remainder |

Alloys 1, 2 and 3 were obtained by powder metallurgy, i.e. they were melted at 900° C., atomized in a nitrogen atmosphere in the form of particles with a grain size of 300 μm, then compacted under 300 MPa in an isostatic press and then drawn into the form of a 40 mm diameter bar.

For alloys 4, 5 and 6, use was made of spray deposition during which a deposit in the form of a cylindrical billet was obtained and this was then transformed by drawing into a diameter 40 mm bar. The bars from both processes were then treated for 2 hours at between 490° and 520° C., hardened with water and exposed for 8 hours to a temperature between 160° and 190° C.

On testpieces of each them, measurements were carried out on the one hand of the Young's modulus and on the other of the standard 0.2% elastic limit, the breaking load and the elongation successively at 20° C. and 150° C. after maintaining for 100 hours, together with measurements of the fatigue limit at 20° C. at the end of $10^7$ cycles and of the endurance ratio, defined by the ratio between the endurance limit and the breaking load.

The results are given in the following table:

| | 1 | 2 | 3 | 4 | 5 | 6 |
|---|---|---|---|---|---|---|
| Young's modulus in GPa | 87 | 91 | 89 | 90 | 95 | 84 |
| Tension at 20° C. | | | | | | |
| RO,2 in MPa | 350 | 390 | 380 | 387 | 400 | 355 |
| RM in MPa | 430 | 460 | 442 | 455 | 470 | 433 |
| A % | 2.5 | 3.0 | 5.0 | 3.8 | 1.0 | 2.0 |
| Tension at 150° C. after maintaining for 100 h | | | | | | |
| RO,2 in MPa | 290 | 320 | 315 | 323 | 327 | 288 |
| Rm in MPa | 385 | 390 | 387 | 393 | 398 | 380 |
| A % | 5.0 | 6.0 | 8.0 | 5.0 | 2.0 | 6.0 |
| Fatigue limit Lf in MPa after $10^7$ cycles at 20° C. (rotary bending) | 150 | 185 | 192 | 190 | 188 | 155 |
| Endurance ratio (Lf/Rm) | 0.35 | 0.40 | 0.43 | 0.42 | 0.40 | 0.36 |

Zirconium leads to a definite improvement in the fatigue strength, which passes from a limit of 150 to 192 MPa.

Identical results are obtained on parts obtained by spray deposition and melt spinning or planar flow casting.

I claim:

1. Aluminium alloy parts, such as in particular rods, having an improved fatigue strength and which, apart from aluminium, consists essentially of by weight, 11 to 22% silicon, 2 to 5% iron, 0.5 to 4% copper, 0.2 to 1.5% magnesium, and wherein they also contain 0.4 to 1.5% zirconium.

2. Process for obtaining parts formed of the aluminium alloy of claim 1 which comprises the steps of:

subjecting the alloy in a molten state to rapid solidification;

shaping the solidified alloy;

heat treating the shaped alloy at between about 480° C. and about 530° C.;

hardening in water the heat treated shaped alloy; and tempering the hardened shaped alloy at a temperature between about 150° C. and about 200° C.

3. Process according to claim 2 wherein the step of fast solidification is accomplished by atomization, spray deposition or melt spinning.

* * * * *